US007234926B2

(12) United States Patent
Sowards

(10) Patent No.: US 7,234,926 B2
(45) Date of Patent: Jun. 26, 2007

(54) AIR COMPRESSOR ASSEMBLY

(75) Inventor: Brian David Sowards, Mooresville, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 222 days.

(21) Appl. No.: 10/966,805

(22) Filed: Oct. 15, 2004

(65) Prior Publication Data

US 2006/0083650 A1 Apr. 20, 2006

(51) Int. Cl.
*F01C 1/16* (2006.01)
*F03C 2/00* (2006.01)

(52) U.S. Cl. ..... 418/201.1; 418/89; 418/97; 418/DIG. 1; 417/295; 417/313

(58) Field of Classification Search ..... 418/201.1, 418/85, 89, 97, DIG. 1; 417/313, 295
See application file for complete search history.

(56) References Cited

U.S. PATENT DOCUMENTS 4,478,054 A * 10/1984 Shaw et al. ..... 418/DIG. 1
5,494,412 A * 2/1996 Shin ..... 418/DIG. 1
5,795,136 A * 8/1998 Olsaker et al. ..... 418/201.1
6,364,645 B1 * 4/2002 Dieterich ..... 418/201.1

FOREIGN PATENT DOCUMENTS

DE 19739279 3/1999
JP 06042476 A * 2/1994 ..... 418/DIG. 1
WO WO 2084124 A1 * 10/2002

* cited by examiner

*Primary Examiner*—Theresa Trieu
(74) *Attorney, Agent, or Firm*—Michael Best & Friedrich LLP

(57) ABSTRACT

A compressor assembly comprising first and second housing structures connected to one another. A compression chamber is formed integrally within the first and second housing structures. A separation chamber is formed integrally within the first and second housing structures. An internal fluid passage extends between the compression chamber and the separation chamber.

18 Claims, 6 Drawing Sheets

AIR COMPRESSOR ASSEMBLY

BACKGROUND

The present invention relates generally to an air compressor system and more particularly to an integrated air/oil separator tank and oil-flooded air compressor.

An illustrative prior art compressor assembly is shown in FIG. 1. In conventional air compressor systems which utilize an oil-flooded compressor 10, air is compressed in a compression chamber 14 or airend within a compressor housing 12 by a set of rotary screws 16, 18. Each rotary screw 16, 18 is supported by a pair of end bearings 20, 22 and 24, 26, respectively. One end of the compressor housing 12 is open to allow the rotors 16, 18 to be positioned in the compression chamber 14. A secondary housing 32 is configured to close the compressor housing 14 once the rotors 16, 18 are installed. The secondary housing 32 includes bores to receive two of the bearing assemblies 22 and 26 which are inserted as indicated by arrow B in FIG. 1. A cover plate 34 is then attached to the secondary housing 32 to close the bores. The opposite end of the compressor housing 12 has a pair of bores to receive the bearings 20 and 24 which are inserted as indicated by the arrow A in FIG. 1. A secondary cover plate 30 is attached to compressor housing 12 to cover the bores. Each connection of a cover to a housing or a housing to a housing provides a potential leak path.

In an oil-flooded compressor, a lubricant, such as oil, is injected into the compression chamber 14 and mixes with the compressed air. The oil is generally injected into the compression chamber 14 for a number of reasons including cooling the air compressor system, lubricating bearings, balancing axial forces and sealing the rotary screws 16, 18. Although using oil is essential for operating these types of air compressor systems, the oil must be removed from the stream of compressed air before the compressed air may be used downstream for pneumatic equipment and/or other tools.

Thus, in such conventional air compressor systems, the compressed air and oil mixture discharged from the airend of the compressor flows with a high velocity into a separator tank 40 where the air and oil of the air/oil mixture are caused to separate. Separator tanks 40 are usually cylindrical tanks mounted either vertically or horizontally. In vertically mounted separator tanks 40, the air/oil mixture is directed tangentially around an inner wall of a separation chamber. The combination of the centrifugal forces acting on the air/oil mixture and contact between the air/oil mixture and the inner wall of the separation chamber causes much of the oil to separate from the air/oil mixture, thereby allowing gravity to draw the oil downwardly into a lower portion of the separation chamber and also allowing the air to separate from the oil and flow upwardly in the separation chamber. In horizontally mounted separator tanks 40, the air/oil mixture enters at high speed and collides with the end wall of the tank. The air/oil mixture then flows in the opposite direction at a slower velocity due to an increase in diameter. The impingement followed by a slowed velocity allows gravity to draw the oil downwardly into a lower portion of the separation chamber. Both of these types of separation effects are known in the art as primary separation.

As generally known, an air/oil separator tank 40 for an oil-flooded air compressor system generally provides two functions. The separator tank 40 provides a means to separate oil from the air/oil mixture introduced into the separation chamber as described above and it also functions as an oil sump for the compressor system.

Conventional air compressor systems as described above include multiple hoses 42, tubes, pipes or the like and associated fittings connecting a compressor 10 to a separator tank 40. Hoses 42 and associated fittings provide potential leak paths which, if developed, could adversely affect the overall operation of the compressor system. Using hoses 42 and associated fittings also requires additional assembly time. Thus, there is a need for an air compressor system which eliminates or at least reduces the number of hoses and associated fittings used to connect a compressor to a separator tank.

Additionally, since conventional air compressor systems use a hose 42, typically a flexible hose, to connect the compressor 10 to a separator tank 40, the compressor 10 and the separator tank 40 are not securely attached as a single unit, thereby making it virtually impossible to maneuver the entire compressor system as one. In addition, since the compressor 10 and the separator tank 40 are individual units, each is provided with its own isolation or supporting mounts, thereby adding undesirable cost to the overall compressor system. Thus, there is a need for an air compressor system which is easier to handle and which is assembled together in such a way that the entire compressor system can be handled or moved as a single unit, and which is also mountable to an associated subbase, so as to provide a more cost effective compressor system.

SUMMARY

The present invention provides a compressor assembly comprising first and second housing structures connected to one another. A compression chamber is formed integrally within the first and second housing structures and a separation chamber is formed integrally within the first and second housing structures. An internal fluid passage extends between the compression chamber and the separation chamber.

DETAILED DESCRIPTION OF THE PREFERRED EMBODIMENTS

Figure 1:
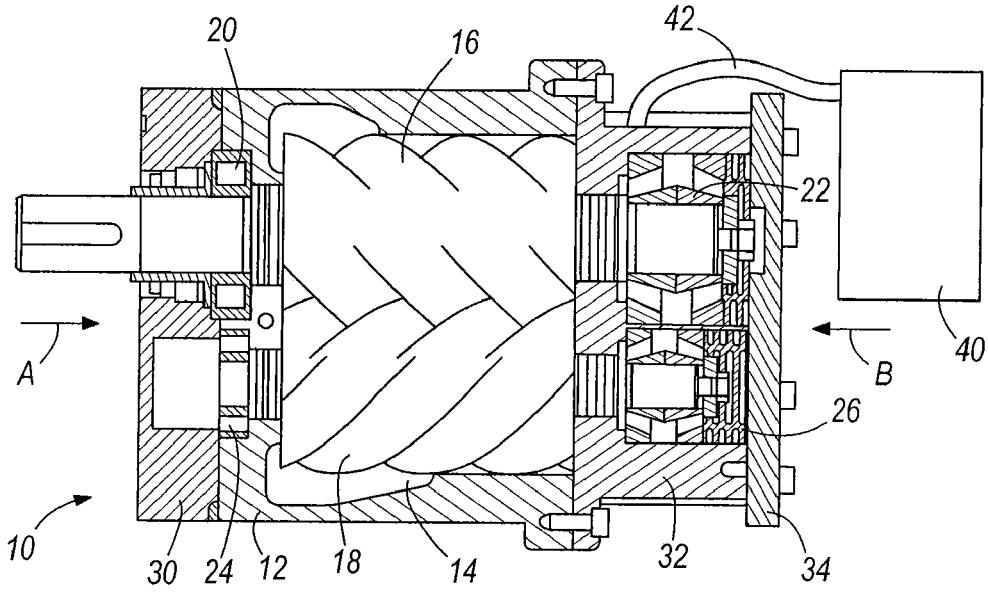
FIG. 1 (PRIOR ART)
FIG. 1 is a side elevation view, in partial section, of an illustrative prior art compressor and separator tank.
Figure 2:
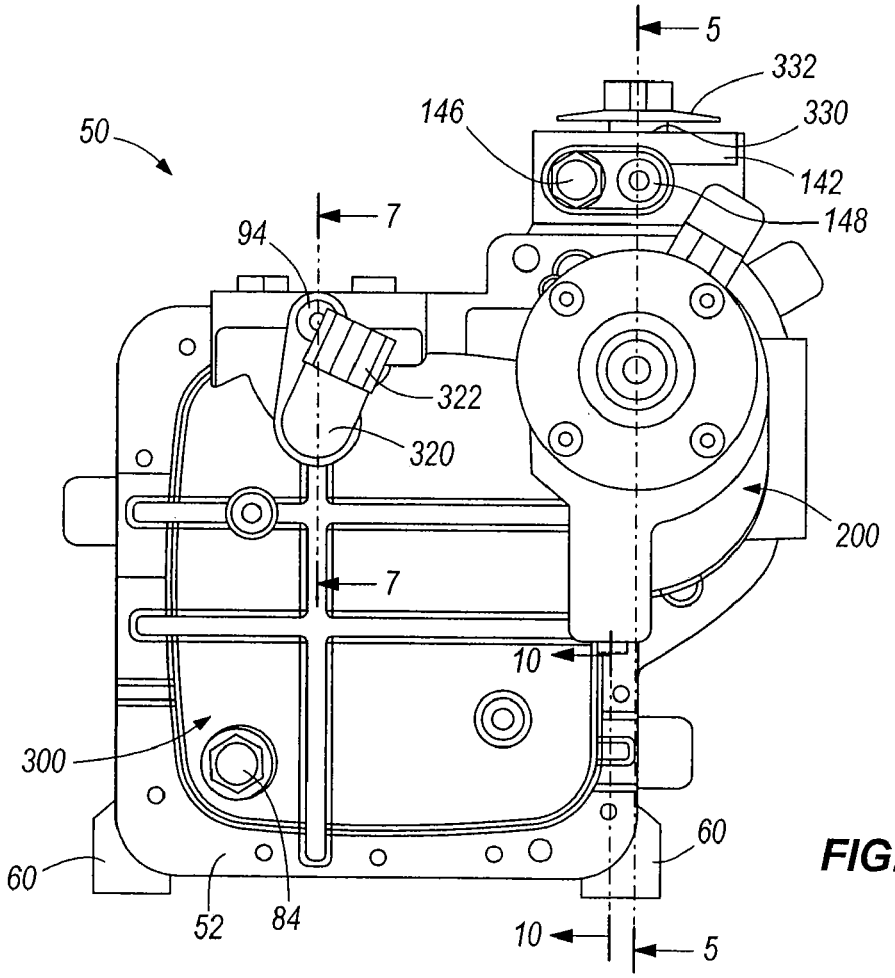
FIG. 2 is a rear elevation view of the compressor assembly that is a first embodiment of the present invention.
Figure 3:
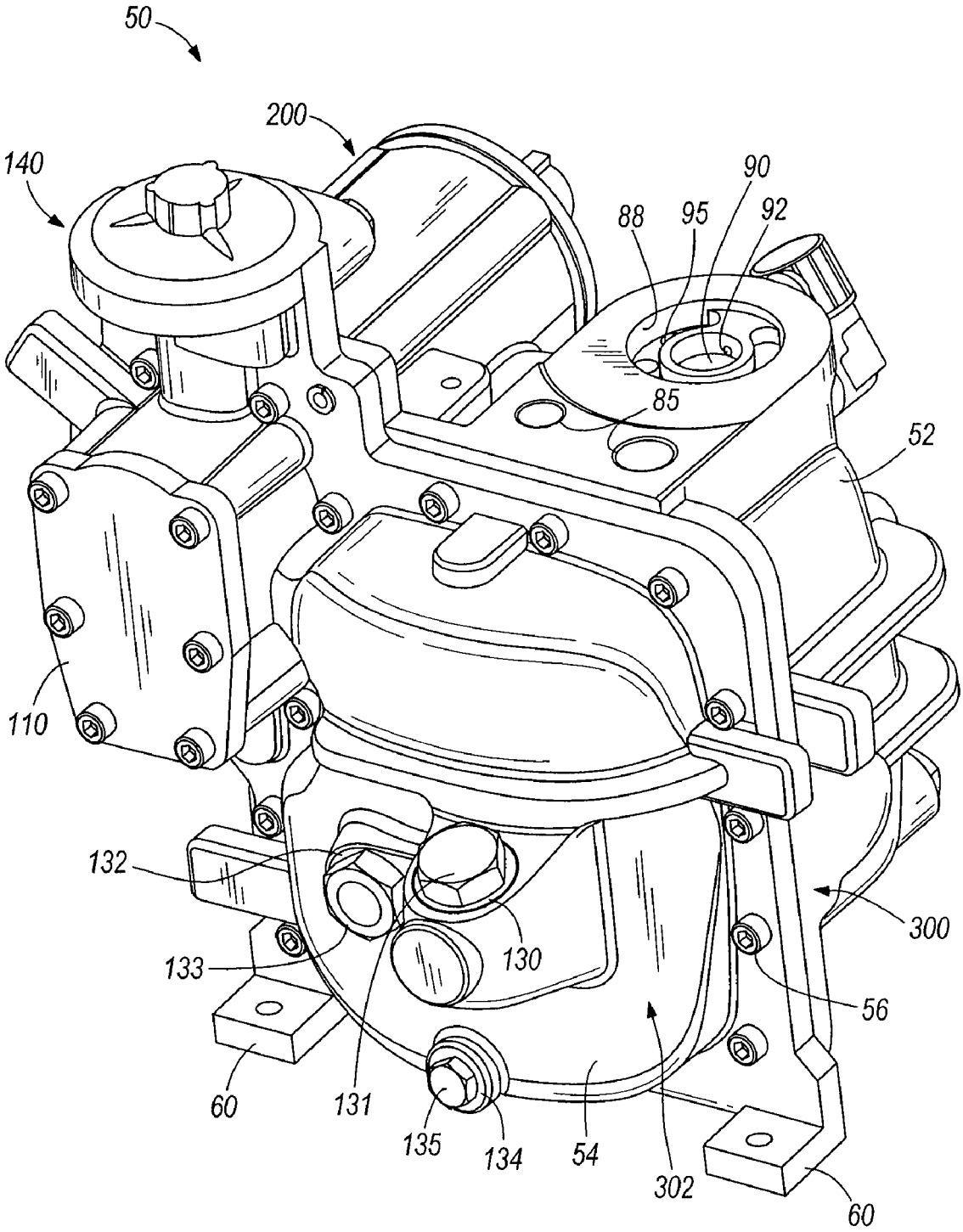
FIG. 3 is a front, right isometric view of the compressor assembly of FIG. 2.
Figure 4:
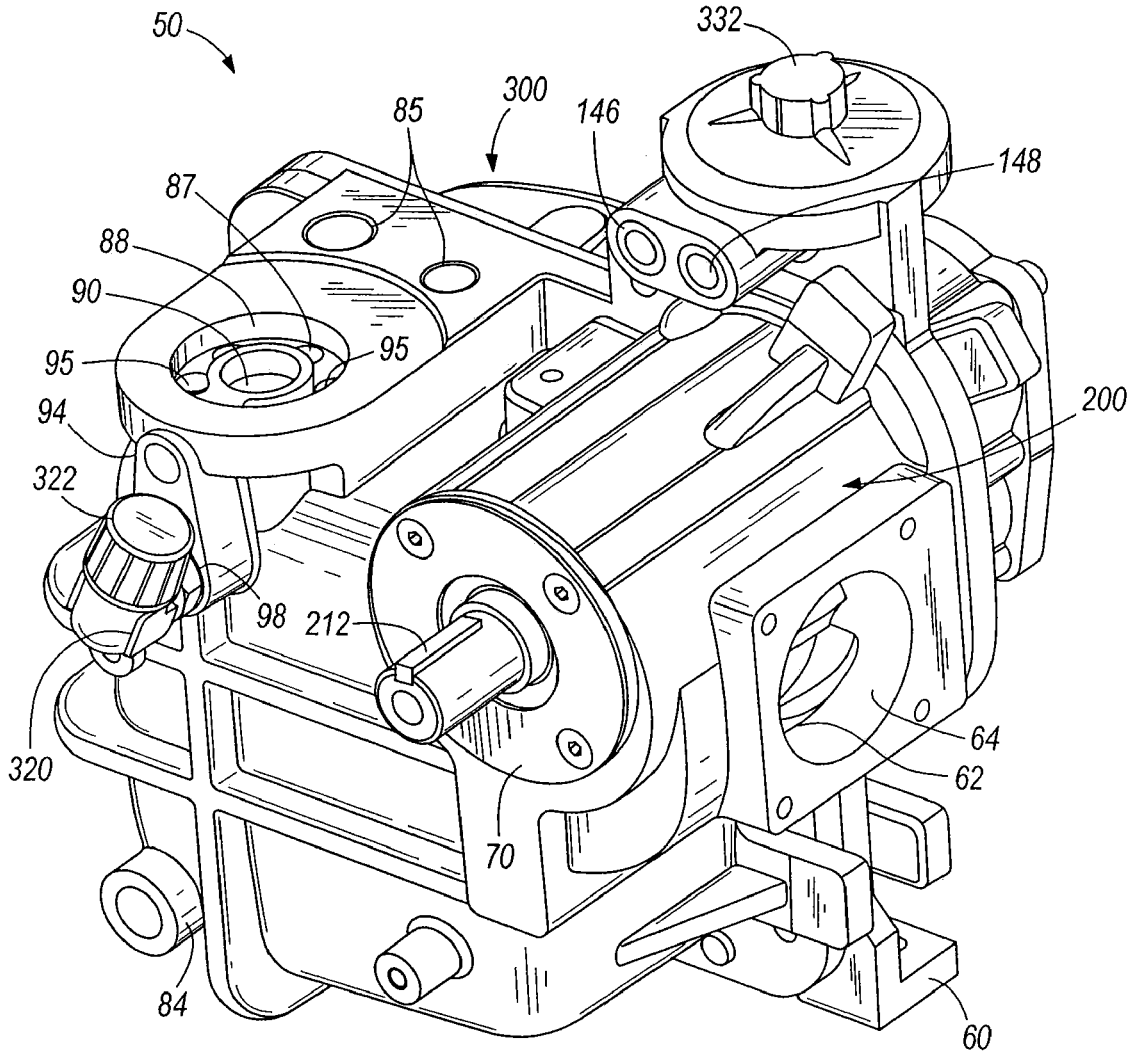
FIG. 4 is a rear, left isometric view of the compressor assembly of FIG. 2.

The present invention will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting.

Referring to FIGS. 2-10, an air compressor assembly 50 that is a first embodiment of the present invention is shown. The air compressor assembly 50 generally includes a compressor 100 and a separator tank 200. The compressor 200 and separator tank 300 are formed integrally within a pair of opposed first and second housing structures 52 and 54. The housing structures 52 and 54 are interconnected with a plurality of bolts 56 or the like and a seal 58 is provided therebetween (see FIG. 5). The housing structures 52 and 54 are preferably manufactured through a casting process, however, may be otherwise manufactured. The second housing 54 preferably has a pair of feet 60 formed integral therewith to support the compressor assembly 50. The feet 60 may alternatively be provided on the first housing structure 52, alone, or in conjunction with the feet 60 on the second housing structure 54.

Referring to FIGS. 3-6, the first housing structure 52 will be described. The first housing structure 52 defines a compression chamber 62 with an air inlet 64 in communication therewith. The air inlet 64 can have various configurations and is preferably configured to support an inlet control valve (not shown) which controls flow of air into the compression chamber 62. The first housing structure 52 includes an opening 66 at the mating surface with the second housing structure 54 to permit insertion of the rotors 202 and 204 in to the compression chamber 62. Each rotor 202, 204 has an end that extends from the opening 66 to be received in the second housing structure 54 as will be described hereinafter. The opposite end of rotor 202 passes through a through bore 68 at the opposite end of the first housing structure 52. The rotor 202 is supported by a bearing assembly 206 positioned in the through bore 68. A seal 208 is positioned about the shaft of the rotor 202 between the bearing assembly 206 and a cover plate 70 attached to first housing structure 52. The seal 208 preferably extends from the inside surface of the through bore 68 and a wear sleeve 210 attached to the shaft of the rotor 202. As such, the cover plate 70 is not required to provide any sealing function. A portion of the shaft of the rotor 202 extends past the plate 70 and has a key 212 configured for engagement with a drive assembly (not shown).

The opposite end of rotor 204 is received in an internal bore 72 in the first housing structure 52. The internal bore 72 opens to the compression chamber 62, but is otherwise closed except for an oil passage 160 as will be described hereinafter. The rotor 204 is supported for rotation by a compact needle roller bearing 214 which is configured to be loaded from inside the compression chamber 62. Since the internal bore 72 is open only to the compression chamber 62, the need to seal the bore 72 is eliminated.

The first housing structure 52 further includes a chamber 80 that forms a portion of the separation chamber 302 of the separation tank 300 as will be described hereinafter. The chamber 80 preferably has concave wall surfaces 82 such that the wall surfaces 82 promote circumferential flow of the fluid that enters the separation chamber 302. A port 84 is provided adjacent to the bottom of the chamber 80. The port 84 is configured to receive a fitting or the like to connect to a hose or piping (not shown) to supply oil back to the compressor 200 as will be described hereinafter. The chamber 80 may be provided with additional ports 85 which may be configured to receive a pressure relief valve 215 (see FIG. 6) or other desired components.

Referring to FIGS. 3-5 and 7, the first housing structure 52 has an integrally formed separator element support 88 in communication with chamber 80. The separator element support 88 includes a passage 87 that is in communication with the separation chamber 80. A canister separator element 317 (see FIG. 6) or the like is attached to the support 88 such that the air/oil mixture passing through the passage 87 passes in to the separator element 317. The separator element 317 performs secondary separation and removes the remaining entrained oil. The separator element 317 is configured to direct the separated oil to a reservoir 90 formed in the support 88. The removed oil travels from the reservoir 90 through an internal passage 92 to an oil exit port 94. The port 94 is connected with a scavenge tube (not shown) that delivers the separated oil back to the separator chamber 302. The separator element 317 is further configured to direct the cleaned area through passages 95 past the reservoir to an outlet passage 96 which terminates in an air exit port 98. The air exit port 98 is configured to receive a connector 320, nipple, valve, for example, a minimum pressure check valve, or the like which is connected to a hose or the like to deliver the cleaned, compressed air to a downstream application. The illustrated connector 320 is shown with a shipping cover 322 which is removed during installation.

The preferred second housing structure 54 will be described with reference to FIGS. 3-5 and 8-9. The second housing structure 54 includes a rotor support section 100. The rotor support section 100 includes a planar surface 101 configured to mate against and substantially close the opening 66 in the first housing structure 52. First and second through bores 102, 104 are provided through the planar surface for passage of the shafts of the respective rotors 202, 204. Through bore 102 passes to a bearing bore 106 and through bore 104 passes to a bearing bore 108. Each bearing bore 106, 108 has a bearing 216, 218, respectively, positioned therein to support the shaft of the respective rotor 202, 204. Each bearing bore 106 and 108 may further include a spring 220, a screw 222 and a clamp plate 224, or other components to provide desired rotor shaft adjustment. A cover plate 110 covers and seals the bearing bores 106 and 106. A sealing gasket 112 or the like is preferably provided between the cover plate 110 and the second housing structure 54.

The second housing structure 54 further includes a chamber 124 configured to align with the chamber 80 of the first housing structure 52 to define the separation chamber 302. An air passage 120 passes through the planar surface 101 to a separator inlet 122. The air passage 120 is configured to align with the ends of the rotors 202, 204 such that the air compressed by the rotors 202, 204 passes through the passage 120 and the separator inlet 122 in to the chamber 124 of the separator chamber 302. The walls 126 of the chamber 124 are preferably concave and the inlet 122 is configured to direct the compressed air tangential to the wall 126 to create circumferential flow of the fluid in the separation chamber 302. The second housing structure 54 preferably has one or more ports 130, 132, 134 in communication with the chamber 124. For example, port 130 provides an oil fill port and is closed by a plug 131 or the like. Port 132 is configured to receive a sight glass 133 such that the level of fluid within the separation chamber 302 may be monitored. Port 134 provides a drain port in the event the oil is to be removed. The port 134 is closed by a plug 135 or the like.

The second housing structure 54 further includes an oil filter support 140 formed integral therein. The support 140 includes a support platform 142 with a bore 144 therein. The bore 144 is configured to receive an oil filter nipple 330 that is configured to be attached to a canister oil filter (not shown) or the like. The nipple 330 is illustrated with a shipping cover 332 thereon which is removed at the time of installation. The support 140 includes an oil inlet port 146 (see FIGS. 2 and 4) that is in communication with the bore 144. The inlet port 146 is configured to receive a connector or the like and receives oil provided from the chamber port 84 and the separator port 94. The oil passes through the port 146 to the nipple 330 and in to the oil filtered. The filter is configured to return the cleaned oil through the nipple 330 to an oil exit passage 147. The oil exit passage 147 is in communication with an oil exit port 148 and an internal lubrication passage 150. The oil exit port 148 connects to a hose or the like to deliver the cleaned oil to the inlet side of the compression chamber 62.

Figure 5:
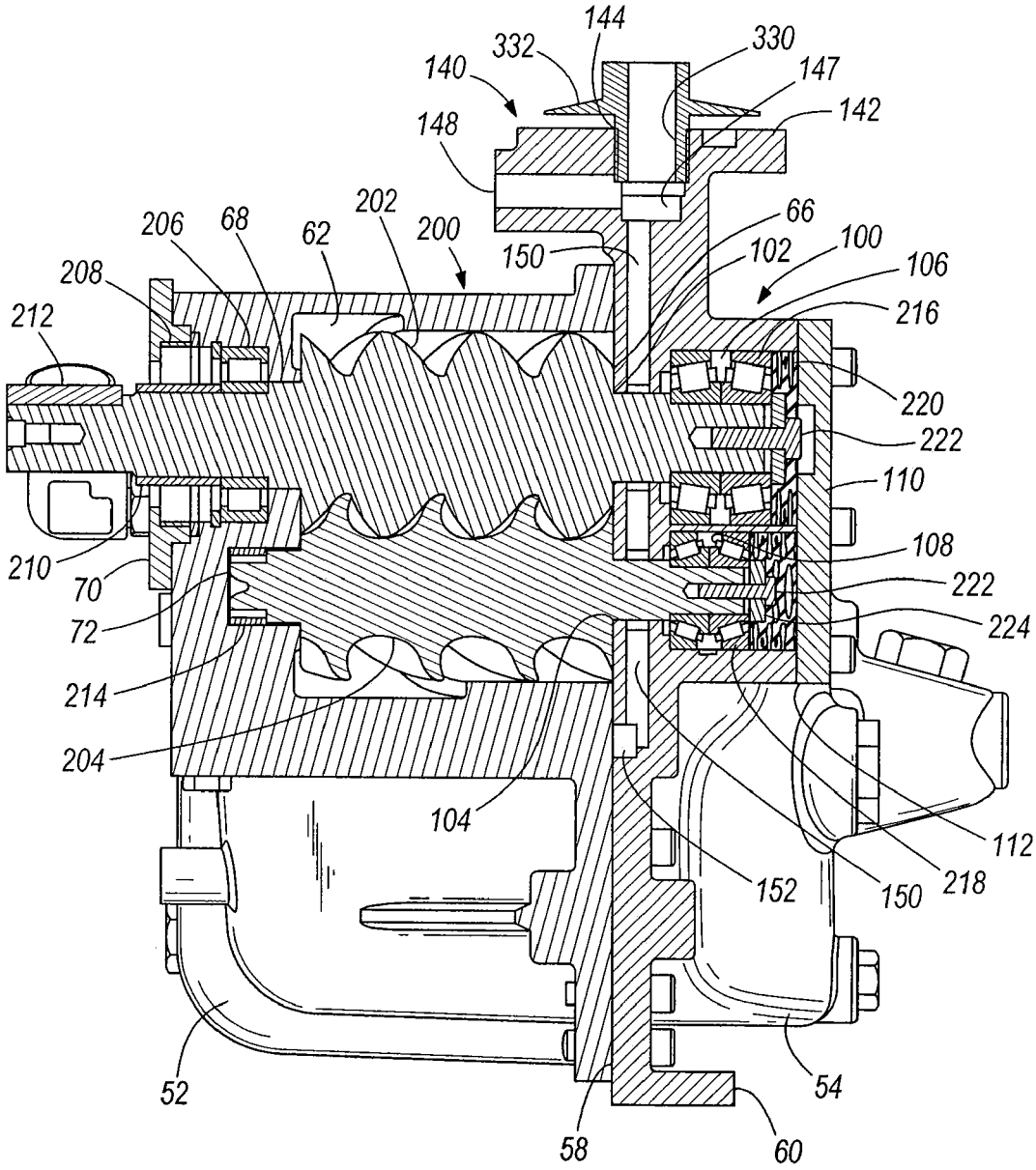
FIG. 5 is a section view along the line 5-5 in FIG. 2.
Figure 6:
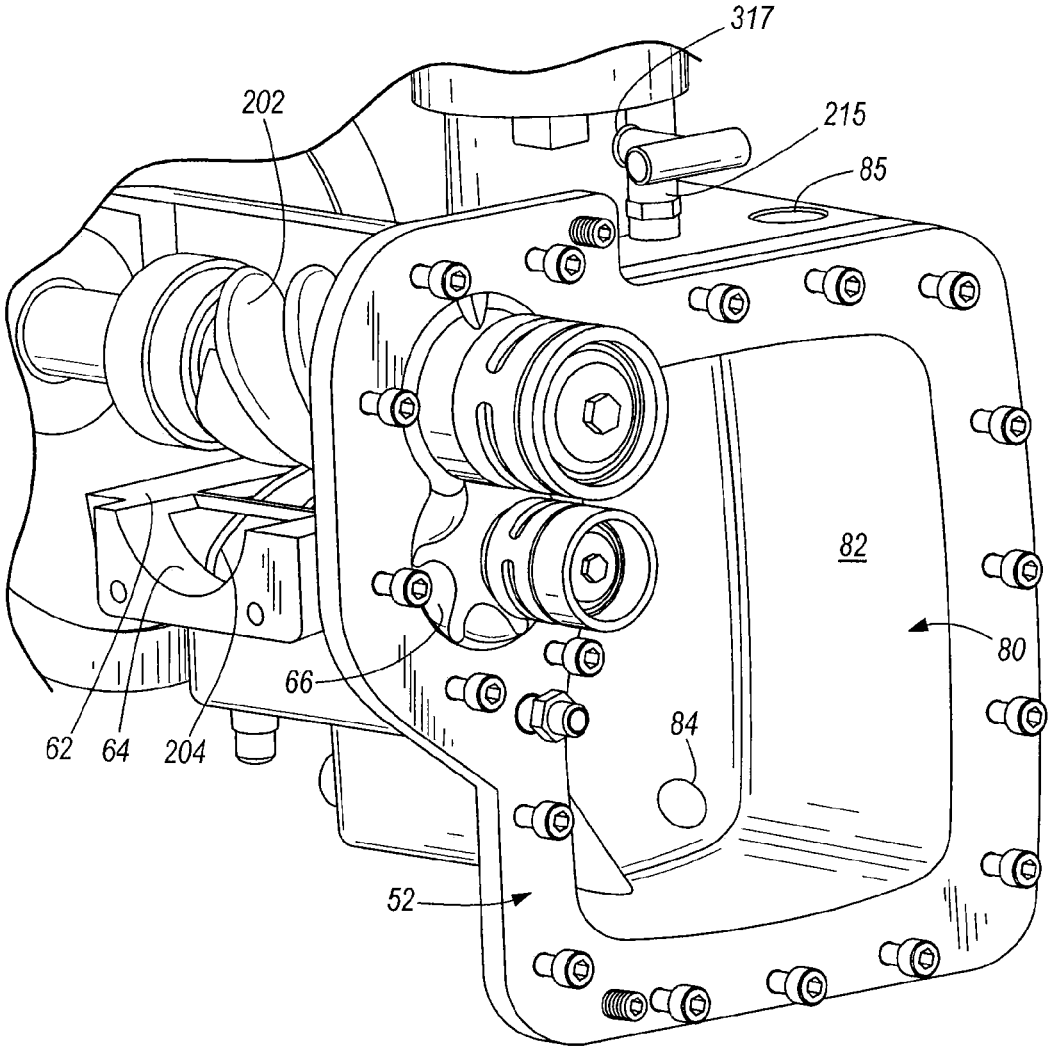
FIG. 6 is a front, left isometric view of the compressor assembly of FIG. 2 with the second housing structure removed and a portion of the first housing structure removed to reveal the compressor chamber.
Figure 8:
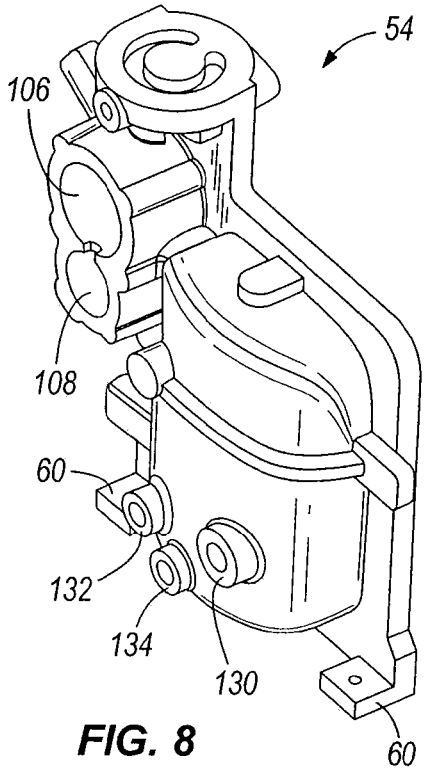
FIG. 8 is a front, right isometric view of the second housing structure.
Figure 9:
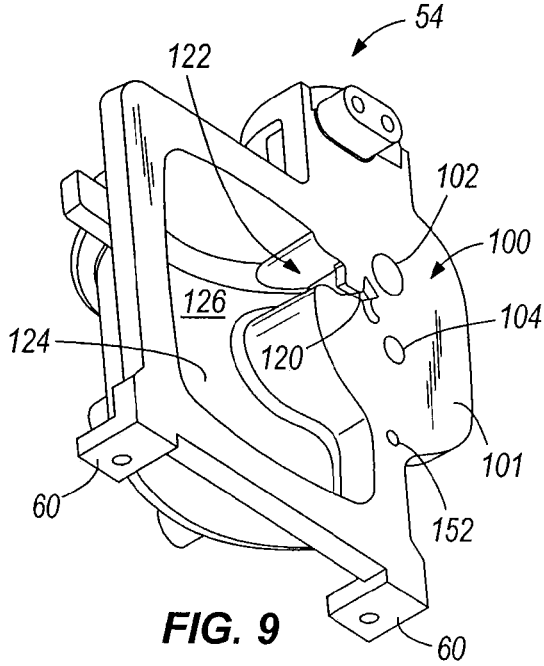
FIG. 9 is a rear, right isometric view of the second housing structure.
Figure 7:
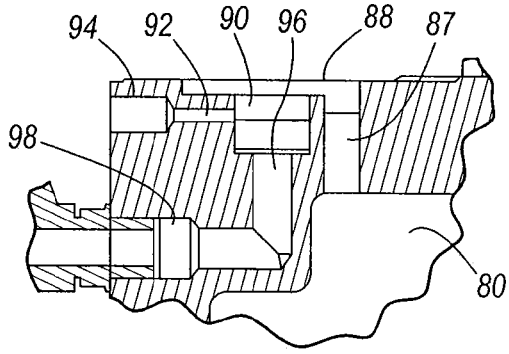
FIG. 7 is a section view along the line 7-7 in FIG. 2.
Figure 10:
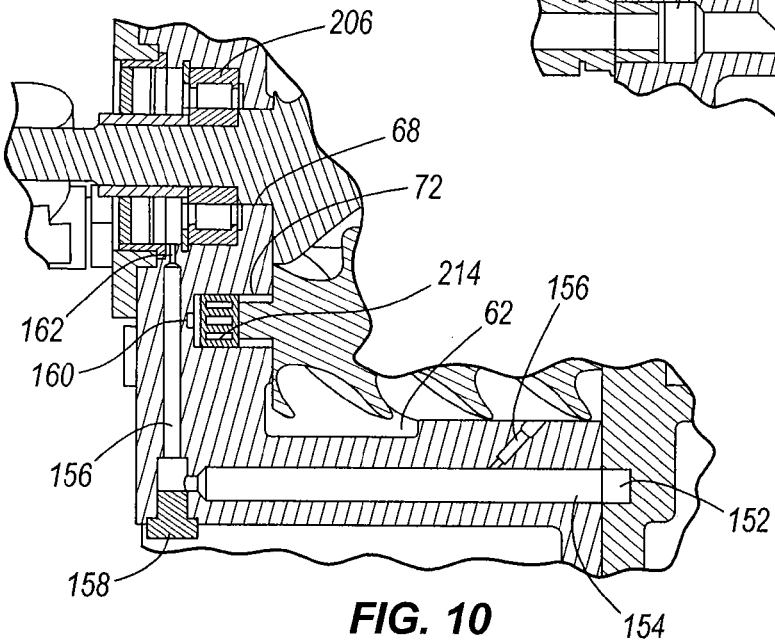
FIG. 10 is a section view along the line 10-10 in FIG. 2.

The internal lubrication system is shown in FIGS. 5 and 10. The internal lubrication passage 150 is formed integrally within the second housing structure 54 and passes through the rotor support section 100 and is in communication with the through bores 102, 104. Oil traveling through the passage 150 thereby travels through the bores 102 and 104 to lubricate the bearings 216 and 218. The passage 150 continues to a junction 152 formed in the second housing structure 54. The junction 152 aligns with a passage 154 formed integrally within the first housing structure 52 that passes adjacent the compression chamber 62. A branch 156 extends from the passage 154 in to the compression chamber 62 to provide fluid to the chamber 62. The passage 154 connects to a passage 156 extending toward bores 68 and 72. A port 158 is preferably provided at the junction of passages 154 and 156 to allow draining of the passages 150, 154 and 156 if necessary. A branch 160 extends from passage 156 to bore 72 to provide lubrication to the bearing 214. A branch 162 extends from passage 156 to bore 68 to provide lubrication to the bearing 206. The internal lubrication system provides direct lubrication to all of the bearings 206, 214, 216, 218 and to the compression chamber 62 without any external tubing.

What is claimed is:

1. A compressor assembly comprising:

first and second housing structures connected to one another;

a compression chamber formed integrally within the first and second housing structures;

a separation chamber formed integrally within the first and second housing structures; and an internal fluid passage between the compression chamber and the separation chamber, wherein the first housing structure defines the compression chamber with a substantially closed end, with the exception of a single bore to support a first rotor shaft, and a substantially open end configured to receive the first rotor shaft and a second rotor shaft.

2. The compressor assembly of claim 1, further comprising an internal bore that is closed at one end and opens at a second end to the compression chamber, the internal bore receiving and supporting the second rotor shaft.

3. The compressor assembly of claim 2 wherein a needle roller bearing is positioned in the internal bore about the second rotor shaft.

4. The compressor assembly of claim 1 wherein the second housing structure seals the compression chamber open end except for first and second rotor shaft bores and the internal fluid passage.

5. The compressor assembly of claim 1 wherein the separation chamber has a top surface and a bottom surface and the fluid passage is adjacent to the top surface.

6. The compressor assembly of claim 1 wherein the first and second housing structures include feet that support both the compression chamber and the separation chamber.

7. A compressor assembly comprising:

first and second housing structures connected to one another;

a compression chamber formed integrally within the first and second housing structures;

a separation chamber formed integrally within the first and second housing structures; and an internal fluid passage between the compression chamber and the separation chamber, wherein the separation chamber has a substantially cylindrical configuration defined by mated chambers in the first and second housing structures having concave surfaces.

8. The compressor assembly of claim 7 wherein the fluid passage directs fluid in to the separation chamber tangential to the concave surfaces.

9. The compressor assembly of claim 8 wherein the separation chamber has a top surface and a bottom surface and the fluid passage is adjacent to the top surface.

10. The compressor assembly of claim 9 wherein an oil exit port is provided adjacent the bottom surface and is formed integrally with the first or second housing structure.

11. A compressor assembly comprising:

first and second housing structures connected to one another;

a compression chamber formed integrally within the first and second housing structures;

a separation chamber formed integrally within the first and second housing structures;

an internal fluid passage between the compression chamber and the separation chamber; and a separator element support formed integrally with the first housing structure, the separator element support configured to support a secondary separation element and including a fluid passage from the compression chamber to the secondary separation element.

12. The compressor assembly of claim 11 wherein the separator element support further includes an internally formed oil exit passage extending from the secondary separation element to an oil exit port.

13. The compressor assembly of claim 11 wherein the separator element support further includes an internally formed air exit passage extending from the secondary separation element to an air exit port.

14. A compressor assembly comprising:

first and second housing structures connected to one another;

a compression chamber formed integrally within the first and second housing structures;

a separation chamber formed integrally within the first and second housing structures;

an internal fluid passage between the compression chamber and the separation chamber; and an oil filter support formed integrally with the second housing structure, the oil filter support configured to support an oil filter and including an internal oil input passage in communication with the oil filter and an internal cleaned oil exit passage in communication with the oil filter.

15. The compressor assembly of claim 14 wherein the cleaned oil exit passage is in communication with a cleaned oil exit port.

16. The compressor assembly of claim 14 wherein the cleaned oil exit passage is in communication with an internal lubrication system.

17. The compressor assembly of claim 16 wherein the first and second housing structures further comprise first and second bearing bores configured to receive first and second bearings that support a first rotor and third and fourth bearing bores configured to receive third and fourth bearings that support a second rotor and wherein the internal lubrication system provides an internal lubrication passage in communication with the first, second, third and fourth bearing bores.

18. The compressor assembly of claim 17 wherein the internal lubrication passage is further in communication with the compression chamber.

* * * * *